United States Patent [19]

Vataru

[11] Patent Number: 4,709,822

[45] Date of Patent: Dec. 1, 1987

[54] BOTTLE CAP WITH SEAL CUTTER IN TOP RECESS

[75] Inventor: Marcel Vataru, Los Angeles, Calif.

[73] Assignee: Wynn Oil Company, Fullerton, Calif.

[21] Appl. No.: 895,205

[22] Filed: Aug. 11, 1986

[51] Int. Cl.[4] ..... B65D 41/50

[52] U.S. Cl. ..... 215/216; 215/228; 215/257

[58] Field of Search ..... 215/216, 217, 228, 257

[56] References Cited

U.S. PATENT DOCUMENTS

| | | | |
|---|---|---|---|
| D. 281,577 | 12/1985 | Larson et al. | D9/367 |
| D. 281,578 | 12/1985 | Reidel | D9/375 |
| D. 282,633 | 2/1986 | Beaver et al. | D9/375 |
| D. 282,634 | 2/1986 | Beaver et al. | D9/375 |
| D. 282,635 | 2/1986 | Beaver et al. | D9/376 |
| 1,349,511 | 8/1920 | Kandlbinder . | |
| 2,131,774 | 10/1938 | Waring . | |
| 2,771,218 | 11/1956 | Henderson . | |
| 2,837,233 | 6/1958 | Kravitz . | |
| 4,340,147 | 7/1982 | McIntosh | 215/226 |
| 4,436,211 | 3/1984 | Gach | 215/216 |
| 4,519,518 | 5/1985 | Wiles et al. | 215/331 |
| 4,529,095 | 7/1985 | Hansen | 215/31 |
| 4,591,063 | 5/1986 | Geiger | 215/330 |
| 4,634,013 | 1/1987 | Bar-Kokhba | 215/228 |

*Primary Examiner*—Stephen Marcus
*Assistant Examiner*—Nova Stucker
*Attorney, Agent, or Firm*—William W. Haefliger

[57] ABSTRACT

A child resistant upright bottle neck and cap combination if provided, wherein threads formed on its outer side and there being structure at the uppermost end of the neck to close same, the cap having a first skirt and threading formed on the skirt at the inner side thereof to mesh with the neck threads when the cap is rotatably attached to the neck. In this environment there is provided:

(a) first lug structure including a first lug on the neck and protruding sidewardly outwardly thereof, (b) and a second lug on the cap skirt and protruding sidewardly inwardly thereof to engage and ride over the first lug during rotatable attachment of the cap to the neck, (c) and a brake surface formed on the cap generally opposite the second lug and presented inwardly to engage the neck and frictionally resist cap rotation in either direction after the second lug rides over the first lug in a cap tightening direction.

7 Claims, 4 Drawing Figures

BOTTLE CAP WITH SEAL CUTTER IN TOP RECESS

BACKGROUND OF THE INVENTION

This invention relates generally to child resistant caps for bottles, and more particularly concerns a cap that resists turning when rotated on a bottle neck past lock position, as well as a cap that is also usable for severing a seal on the bottle neck.

Prior caps have incorporated locking lugs to rotate past lugs on bottle necks when the caps are rotatably screw threaded onto the bottle necks, for locking purposes; however, such a cap characteristically remains loose on the bottle neck, though locked thereon, until the cap is further rotated to seal against the neck. A child, in attempting to unscrew the cap will twist it from sealed position to loosen it, even though the child cannot twist it past locking position. Such looseness can and does contribute to problems of fluid leakage from the bottle or container neck, while the cap remains locked on the neck, as for example when the container or bottle is turned upside down, or inclined from vertical.

In an effort to prevent leakage, seals have been placed across bottle neck openings; however, once broken, the seals did not prevent leakage. Also, prior bottle caps that incorporate knives to sever such seals constitute a problem in that the cutters were centrally exposed on the caps and thus were easily manually accessible, creating danger and risk of cut fingers during cap manipulation.

Wearing and breakage of locking lugs on the cap and bottle neck was also a problem, due to their construction, so that inadvertent unlocking can and did occur.

There is need for an improved cap overcoming these as well as other problems with bottles and container caps

SUMMARY OF THE INVENTION

It is a major object of the invention to provide an improved cap meeting the above needs. Basically, the invention provides for a child resistant upright bottle neck and cap combination, the neck having threads formed on its outer side, and a seal strip being located across the uppermost end of the neck to close same, and the cap having a first skirt and threading formed on the skirt at the inner side thereof to mesh with the neck threads when the cap is rotatably attached to the neck. In this environment the improvement includes:

(a) first lug means including a first lug on the neck and protruding sidewardly outwardly thereof, (b) and a second lug on the cap skirt and protruding sidewardly inwardly thereof to engage and ride over the first lug during such rotatable attachment of the cap to the neck, (c) and a brake surface formed on the cap generally opposite the second lug and presented inwardly to engage the neck and frictionally resist cap rotation in either direction after the second lug rides over the first lug in a cap tightening direction.

Typically, the cap has inward wall thickening that defines the brake surface, the thickening extending over an arc of at least about 25° as measured about an axis defined by the cap. Further, the first lug and second lug are separated by an angle of less than 90° about a central axis defined by the cap, when the cap is tightened on the neck; and the cap has an end wall, and a seal across the inner side of said end wall to engage the upper end of the neck when the cap is rotatably attached to and tightened on the neck. In addition, the wall thickening is typically locally relieved, radially, to allow flexing of the wall to distort the cap for reverse rotation of the cap second lug past the neck first lug when removal of the cap from the neck is desired.

It is a further object to provide a cap having a divider wall and a second skirt extending upwardly from said divider wall and oppositely of the first skirt, and cutter means on the cap proximate that end wall to cut the seal strip when the second skirt is fitted onto the neck and rotated. The second skirt has an inner side that is cylindrical to loosely interfit the bottle neck so that the cutter means may be self interfitting with the neck to puncture the seal; and the cutter is typically protectively located adjacent that inner wall to protect against inadvertent user finger cutting.

These and other objects and advantages of the invention, as well as the details of an illustrative embodiment, will be more fully understood from the following specification and drawings, in which:

DRAWING DESCRIPTION

DETAILED DESCRIPTION

Figure 1:
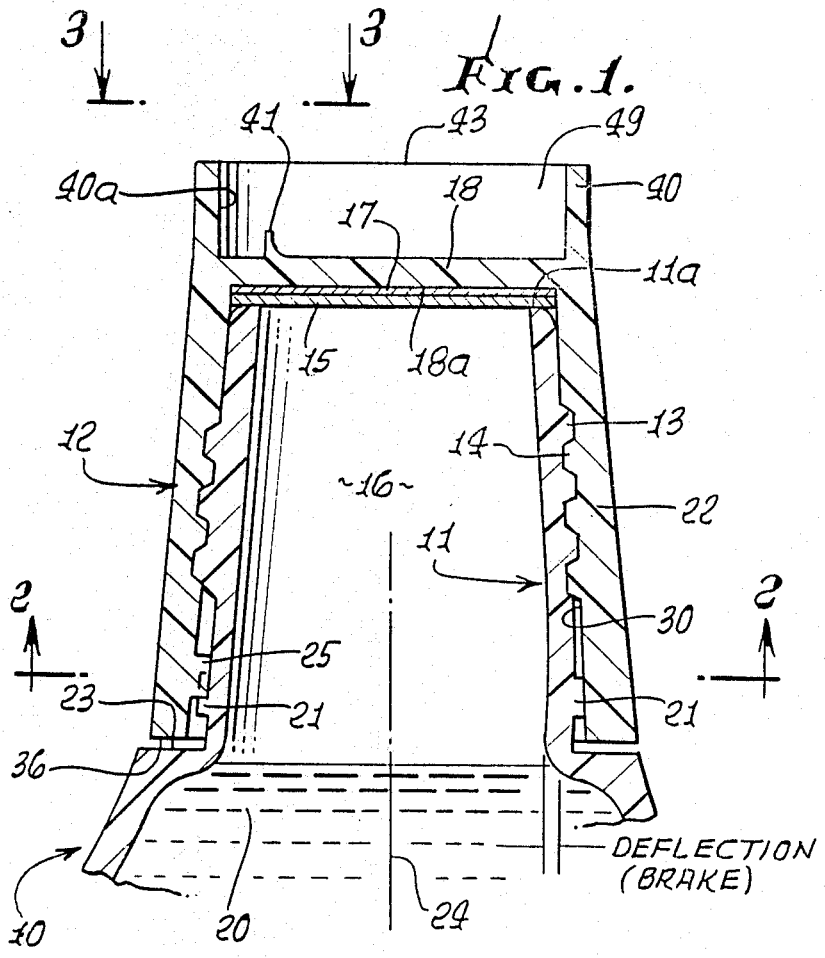
FIG. 1 is an elevation taken in section showing the construction of the improved cap, in relation to a bottle neck.
Figure 3:
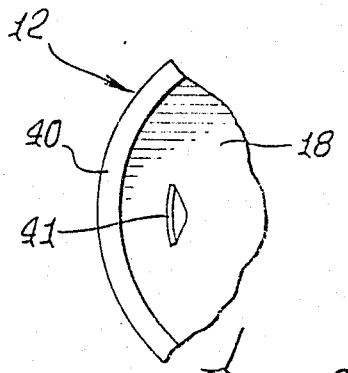
FIG. 3 is a fragmentary section taken on lines 3—3 of FIG. 1.
Figure 2:
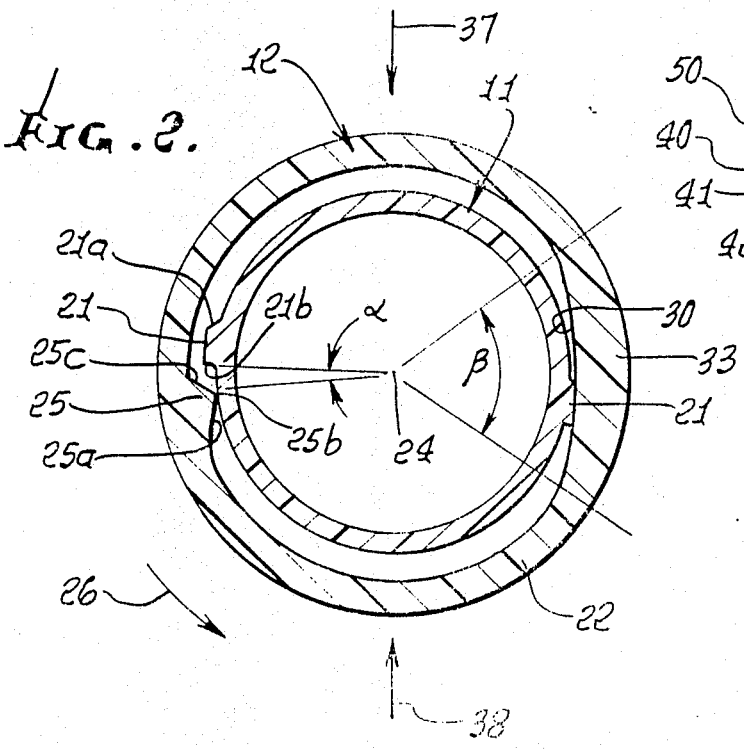
FIG. 2 is a section taken on lines 2—2 of FIG. 1.

In FIG. 1 and 2, a bottle 10 has a neck 11 onto which child resistant cap 12 is received. The neck has external threads 13 formed on its outer side, and the cap has internal threading 14 on the cap skirt 22, that meshes with threads 13 to enable tightening of the cap on the bottle neck as the cap is rotated. A seal strip 15 (such as aluminum foil or liner) is attached as by bonding to the upper rim **11*a* of the neck, to close off the neck interior 16 from the exterior; and a sealing disc 17 is received against the surface 18*a* of cap wall 18 to sealingly engage the strip 15 adjacent rim 11*a* (or to engage that rim if a seal strip is not employed). Strip 15 and/or disc 17 constitute sealing means for the cap. Once seal strip 15 is broken, leakage of bottle fluid contents 20** can occur if the bottle neck rim is retracted sufficiently relative to the disc and the bottle is inverted. Such retraction may be only a few degrees (say 5°–25° of cap rotation in releasing or opening).

First lug means, including a first lug 21 is integrally formed on the neck and protrudes sidewardly outwardly from the neck, at a location below threads 13, and above the bottle shoulder 23 at the lowermost level of the neck. Another such lug 21 may be formed on the neck, as for example diametrically opposite the lug shown. Lug 21 or lugs 21 extend or are elongated in a vertical radial plane that contains neck axis 24.

A second lug 25 is formed on the cap skirt 22 to protrude sidewardly and inwardly, as shown. Lug 25 rides downwardly and circumferentially over lug 21 on the neck as the cap is screwed downwardly on the neck, in a rotary direction as indicated at 26 in FIG. 2. To faciliate such ride-over, without damage, lug 25 has a sector shaped slowly inwardly rising cam surface 25a, an inwardly convex crest 25b, and a more sharply outwardly angled reverse locking surface 25c. Lug 21 may have a protruding cross section, as shown, with angled cam surface 21a and generally radial lock surface 21b. In the position shown in FIG. 2, the cap is locked on the neck since lug 21 blocks reverse rotation of lug 25 if cap 12 is reversely rotated, to engage lug surfaces 21b and 25c. Also in the position shown in FIG. 2, those surfaces are spaced apart by angle $\alpha$, and the seal 17 is compressed by the bottle neck, to prevent leakage. Axial reaction force is exerted through the threads. Reverse rotation of the cap to engage the lugs as in unscrewing direction tends to relieve pressure on the seal and loosen the threads.

In accordance with an important aspect of the invention, a braking surface 30 is formed on the cap generally opposite the second lug 25, and it is presented shallowly concavely inwardly to engage the neck (or the lug 21 thereon as shown) to frictionally resist cap rotation in either direction, throughout the angular range $\alpha$, i.e. after the second lug rides over the first lug to lock the cap on the neck. Note that surface 30 is at the inner side of wall thickened area 33, and its angular width $\beta$, circumferentially exceeds the angle $\alpha$. Thus, braking engagement of lug 21, or the neck surface, with brake surface 30 occurs throughout the angular range $\alpha$ (less than 90°) of travel of lug 21 between fully tightened condition of the cap, and cap forcible loosening to engage lugs 21 and 25. Such braking is made sufficient that forcible loosening by the child is for all practical purpose prevented, whereas an adult can effect such loosening.

Note that the bottom rim 36 of the cap is spaced above bottle shoulder 23 in tightened condition of the cap on the bottle neck. Removal of the cap off the neck is effected by exerting force on the cap in the direction of arrows 37 and 38 to elongate the cap section seen in FIG. 2 urging lug 25 radially outwardly from lug 21 allowing lug 25 to ride reversely over lug 21 as the cap is untwisted.

Figure 4:
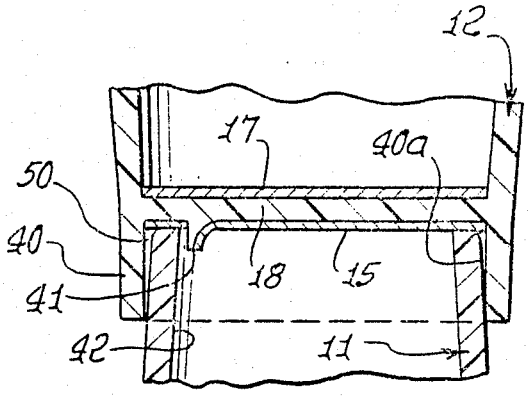
FIG. 4 is a fragmentary elevation showing inversion of the cap, and its interfitting on the bottle neck, to cut a seal strip on the neck.

A further aspect of the invention concerns the provision of a second skirt 40 integral with the cap, and extending annularly and upwardly from the periphery of divider wall 18. The innerside 40a of the second skirt is cylindrical in order to fit loosely over the bottle neck as shown in FIG. 4, (see looseness 50) so that a cutter 41 carried near that wall may be easily fitted downwardly on the bottle neck and the cutter easily located to cut downwardly into, i.e. puncture, the seal strip 15, as shown, adjacent the inner wall 42 of the neck. The inverted cap 12 may then be easily rotated to rotatably sever or cut the strip 15 in a circular direction adjacent the neck wall 42, for exposing the contents of the bottle for pouring.

Location of the cutter near the skirt 40, well down in recess 49 from skirt rim level 43 as seen in FIG. 1, assures minimum exposure of the cutter to the user's fingers.

Skirt 40 also reinforces the structure of the cap to prevent breakage of wall 18 due to stress conditions, resulting from excessive tightening, vibration, increased inside pressure of liquid due to heating, rough handling, etc.

I claim:

1. In a child resistant upright botle neck and cap combination, the neck having threads formed on its outer side and there being means at the uppermost end of the neck to close same, the cap having a first skirt and threading formed on the skirt at the inner side thereof to mesh with the neck threads when the cap is rotatably attached to the neck, the improvement comprising (a) first lug means including a first lug on the neck and protruding sidewardly outwardly thereof, (b) and a second lug on the cap skirt and protruding sidewardly inwardly thereof to engage and ride over said first lug during said rotatable attachment of the cap to the neck, (c) and a brake surface formed on the cap generally opposite said second lug and presented inwardly to engage the neck and frictionally resist cap rotation in either direction after the second lug rides over the first lug in a cap tightening direction, (d) the cap having an inner wall surface including a surface portion that defines said brake surface, said surface portion protruding inwardly toward a central axis defined by the cap, said surface portion smoothly merging with said inner wall surface and extending uninterruptedly over an arc of at least about 25° as measured about said central axis defined by the cap.

2. The improvement of claim 1 wherein the cap has an end wall, and a seal across the inner side of said end wall to engage the upper end of the neck when the cap is rotatably attached to and tightened on the neck.

3. The improvement of claim 2 wherein the first lug and second lug are separated by an angle of less than 90° about a central axis defined by the cap, when the cap is tightened on the neck.

4. The improvement of claim 1 wherein the cap has a divider wall and a second skirt extending upwardly from said divider wall and oppositely of said first skirt, and cutter means on the cap proximate said end wall to cut the seal strip when the second skirt is fitted onto said neck and rotated.

5. The improvement of claim 4 wherein the second skirt has an inner side which is cylindrical and said cutter means is located adjacent said cylindrical inner side.

6. The improvement of claim 2 including a second skirt integral with the cap and extending upwardly from said divider wall and oppositely of said first skirt, and cutter means on the cap proximate said end wall to cut the seal strip when the second skirt is fitted onto said neck and rotated.

7. The improvement of claim 6 wherein the second skirt has an inner side which is cylindrical and said cutter means is located adjacent said cylindrical inner side.

* * * * *